US008112911B2

(12) United States Patent
Trevisani

(10) Patent No.: US 8,112,911 B2
(45) Date of Patent: Feb. 14, 2012

(54) METHOD AND DEVICE FOR MIXING EARTH IN SITU FOR THE FORMATION OF UNDERGROUND WALLS OR DIAPHRAGMS

(75) Inventor: Davide Trevisani, Cesena (IT)

(73) Assignee: SOILMEC, S.p.A, Cesena (IT)

( * ) Notice: Subject to any disclaimer, the term of this patent is extended or adjusted under 35 U.S.C. 154(b) by 263 days.

(21) Appl. No.: 11/487,207

(22) Filed: Jul. 14, 2006

(65) Prior Publication Data

US 2008/0008540 A1 Jan. 10, 2008

(30) Foreign Application Priority Data

Jul. 22, 2005 (IT) ..... TO2005A0503

(51) Int. Cl.
*E21B 10/32* (2006.01)

(52) U.S. Cl. ..... 37/92; 37/189; 175/263; 175/292

(58) Field of Classification Search ..... 37/91, 92, 37/189, 190, 347, 352, 462; 175/263, 292
See application file for complete search history.

(56) References Cited

U.S. PATENT DOCUMENTS

| | | | | | |
|---|---|---|---|---|---|
| 1,899,727 | A * | 2/1933 | Sandstone | 175/263 |
| 3,443,648 | A * | 5/1969 | Howard | 175/103 |
| 4,243,099 | A * | 1/1981 | Rodgers, Jr. | 166/66.4 |
| 4,589,504 | A * | 5/1986 | Simpson | 175/267 |
| 4,846,290 | A * | 7/1989 | Jones | 175/269 |
| 5,255,741 | A * | 10/1993 | Alexander | 166/278 |
| 5,402,856 | A * | 4/1995 | Warren et al. | 175/57 |
| 7,363,733 | B2 * | 4/2008 | Stoetzer | 37/189 |
| 7,367,143 | B2 * | 5/2008 | Stoetzer | 37/189 |
| 7,637,038 | B2 * | 12/2009 | Arzberger et al. | 37/91 |
| 2006/0225308 | A1 * | 10/2006 | Arzberger et al. | 37/91 |

* cited by examiner

*Primary Examiner* — Gary S Hartmann
(74) *Attorney, Agent, or Firm* — Merchant & Gould P.C.

(57) ABSTRACT

A device is suspended from cables or other flexible or articulated structures, for the mixing in situ of earth for the formation of underground walls or diaphragms includes in its lower part a disaggregator (1) for the disaggregation of the earth. Above the disaggregator is positioned a corrector (5, 13) for the direction of the excavation.

12 Claims, 5 Drawing Sheets

METHOD AND DEVICE FOR MIXING EARTH IN SITU FOR THE FORMATION OF UNDERGROUND WALLS OR DIAPHRAGMS

BACKGROUND OF THE INVENTION

The subject of the present invention is a method and a device for mixing earth in situ for the formation of continuous underground walls or diaphragms or single elements.

Technology for in situ earth mixing, with the addition of an opportune stabilising agent, finds applications in a wide range of geotechnical planning problems such as:

- the production of containing walls,
- the massive improvement of the bearing characteristics of the earth,
- the production of waterproof walls,
- the inactivating treatment of polluted sites,
- the reduction of the risk of liquefying sand.

These results are obtained by means of the opportune use of well-established earth elements, either in isolation or combined in order to form geometrically defined structures.

The system may be applied both in strong ground and in compact sand.

There are well-known techniques for mixing natural earth with aggregating fluids, for example based on a mixture of water and cement, in order to form columns of well-established earth.

This kind of mixing is carried out directly in the earth which is disaggregated by means of mechanical tools the rotation of which also provides for mixing with aggregating fluid. The fluid, which is pumped at a low pressure of 0.1-0.3 Mpa, is conveyed via the drill rods to the tool and exits near the disaggregating blades.

SUMMARY OF THE INVENTION

In more advanced version of the method, the aggregating fluid is pumped at a pressure of 20-40 Mpa and exits from special nozzles in the form of jets with a high level of kinetic energy which contributes considerably to the disaggregating and the mixing with the earth. The disaggregating blades move in a mixture which has already been softened by the action of the jets and can rotate with less force, greater speed and can guarantee a minimum diameter of the column and a high rate of advancement (see for example the publications EP-1.045.073 and U.S. Pat. No. 5,396,964).

The patent EP-1.452.645 describes a method for the formation of diaphragms made of earth mixed with aggregating fluid based on equipment with drums which rotate around a horizontal axis equipped with teeth. The horizontal section of the excavation is thus of a rectangular shape. Placing several excavations next to each other means that underground walls (diaphragms) made of well-established earth can be produced. In this case, the low pressure of the fluid and the fixed direction of delivery do not make either drilling or mixing any easier.

Furthermore, the Italian patent no. TO2005A000447 of 28 Jun. 2005 in the name of the same Proprietor describes a method for the formation of earth diaphragms mixed with aggregating fluid based on equipment with a number of vertical parallel rods provided with opposite pair rotation and with tools equipped with disaggregating blades and nozzles for projecting the jets which rotate together with the tools. This kind of equipment may be partially closed within a perimeter of vertical blades which delimit a section of rectangular excavation.

The excavation and mixing device is usually suspended from cables or an articulated guiding member which presents a certain flexibility.

The main problem which has to be solved concerning this kind of mixing equipment is the rectilinear and vertical nature of the excavation. In fact, the final aim of these excavations is to form a single wall of well-established earth which is not very permeable.

The individual panels of the excavation should therefore abut each other and be connected firmly to each other.

Consequently, the minimum prerequisite is their vertical nature and this requires a control system and a system for correcting direction.

The control system is well-known and is based on inclinometers which are relative to the two main planes.

A gyroscope device is generally used to measure the twisting angle.

The measurement signals are usually transmitted via cable to the operating machine in order to be able to carry out a visual check of the situation. They are then processed by an algorithm which denotes the corrective interventions to be performed.

Obviously the transmission of the data may be carried out in a different fashion or may be omitted altogether if the processing is performed locally (inside the excavation device).

In excavation devices from which the debris is removed and the excavation is empty, there is a well-known system which uses thrusting surfaces which act on the walls of the excavation itself, thereby modifying the angle of the device and the direction of its advancement (see EP 0791690). If, however, the fluidised debris remains in the excavation, this system can involve considerable risks due to the large surface area which is in friction with the mixed debris.

In excavation devices with drums with horizontal axes there are well-known methods which use a different rotation speed for the drums in order to obtain movement on the plane which is perpendicular to the rotation axes. Viceversa inclining the drum group in relation to their support obtains movement in the direction of the above-mentioned axes (see EP 0735199).

The aim of the present invention is to correct the direction of the excavation in the direction away from the plane of the panel and in the torsional direction of the panel.

In order to fulfil this and other aims which will be explained better below the invention proposes the production of a device for mixing earth in situ for the formation of underground walls or diagrams according to claim 1 and the relative method according to claim 10.

BRIEF DESCRIPTION OF THE DRAWINGS

The present invention will now be described with reference to the attached drawings in which.

DETAILED DESCRIPTION OF THE PREFERRED EMBODIMENTS

Figure 2:
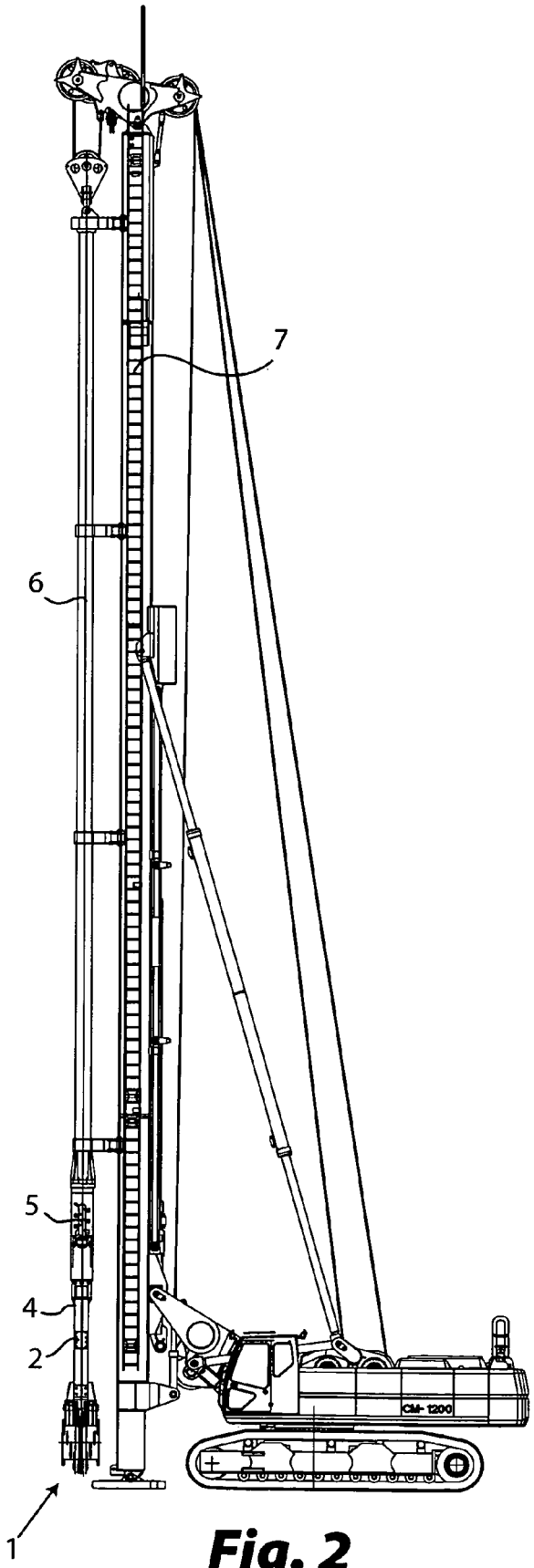
FIGS. 1 and 2 illustrate respectively in frontal and lateral view the excavation device according to the present invention in a first form of embodiment and mounted on a first kind of machine with a rigid antenna.

The excavation device presents disaggregating means which are traditionally made up of a double pair of toothed drums 1 which are independent or mechanically coupled and are motorised with at least a motor element (mounted on the axis of the drums). The motorised part is overlapped by a sealed chamber with an access trapdoor 2 for mounting and maintenance and control circuits.

By means of pipes, which are not illustrated, it may be supplied with the aggregating fluid and/or fluidising liquid at high pressure via nozzles, which are also not illustrated, used to disaggregate any eventual clods of earth which might be found between the toothed drums.

During the phase of advancement into the earth the pair of drums rotate towards the inside where they tend to accumulate shredded earth due to the effect of the action of the teeth and the fluid which is pumped at high pressure (20-40 MPa). A mixing area 3 is created in this zone where nozzles of the type which have previously been described pump aggregating fluid and fluidising liquid derived from the same feed.

According to the present invention, correcting means for the direction of the excavation made up of milling means or motorised mixers are arranged above the body 4 which holds the drums 1.

During the functioning of these correcting means the drums are made to rotate in an opposite direction and that is towards the outside in such a way as to exert a downward pressure which stabilises the fluid and is useful for improving the homogeneous nature of the treatment and tends to move the earth which is present in the mixing chamber 3 downwards. During this action, the drums continue to be aided by the liquid which is fed under pressure by means of the above-mentioned nozzles. As the earth moves downwards it tends to free the chamber between the two drums which will tend to be filled again by the earth from above which has been previously mixed and further kept in motion by the said motorised correcting means.

According to a first form of embodiment, with the aim of correcting the direction of the excavation, upper milling members 5 are used with the aim of correcting the direction of the excavation, having rotation axes which are substantially vertical (see FIGS. 1, 2, 3 and 4).

Each milling member 5 can swing around its own hinge which hinges it to the excavation device and rotate around its own longitudinal axis.

The reaction of the torque which is applied to these in order to keep the earth in motion also acts on the excavation device in its entirety. Thus if both the milling members 5 rotate in the same direction, the excavation device tends to rotate in the opposite twisting direction.

If instead the milling members 5 are made to rotate in an opposite direction, the torque is cancelled out, but not the force of friction on the surrounding material. For reasons of symmetry the residual force has a direction which is perpendicular to the plane of the diaphragm, precisely in the main direction. Inverting the direction of rotation of the milling members also inverts the direction of the correcting force.

Figure 1:
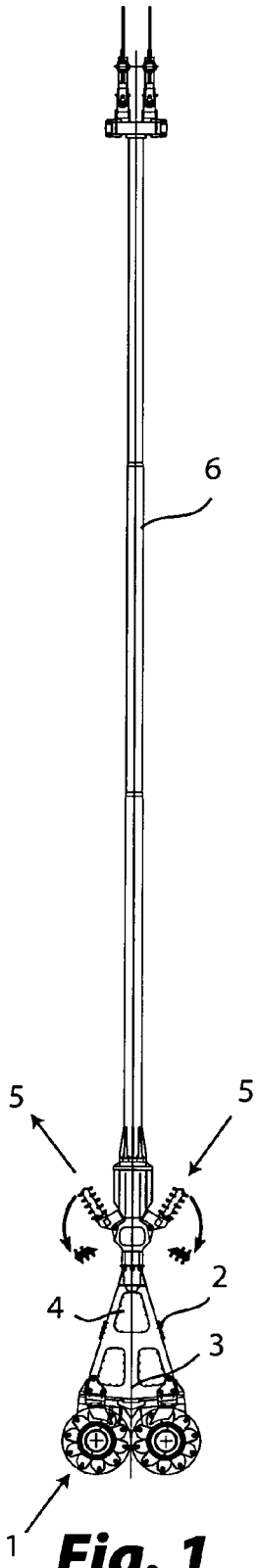

The device, in the configuration of the machine which is shown in FIGS. 1 and 2, ends in its upper part with a rod or antenna 6 which is substantially as long as the depth of the excavation to be reached and which will contain feed pipes or cables of the device and be guided by a guide tower 7 which will prevent any undesirable rotation. The height of such a tower constitutes a limit to the depth which may be reached.

Figures 3, 4:
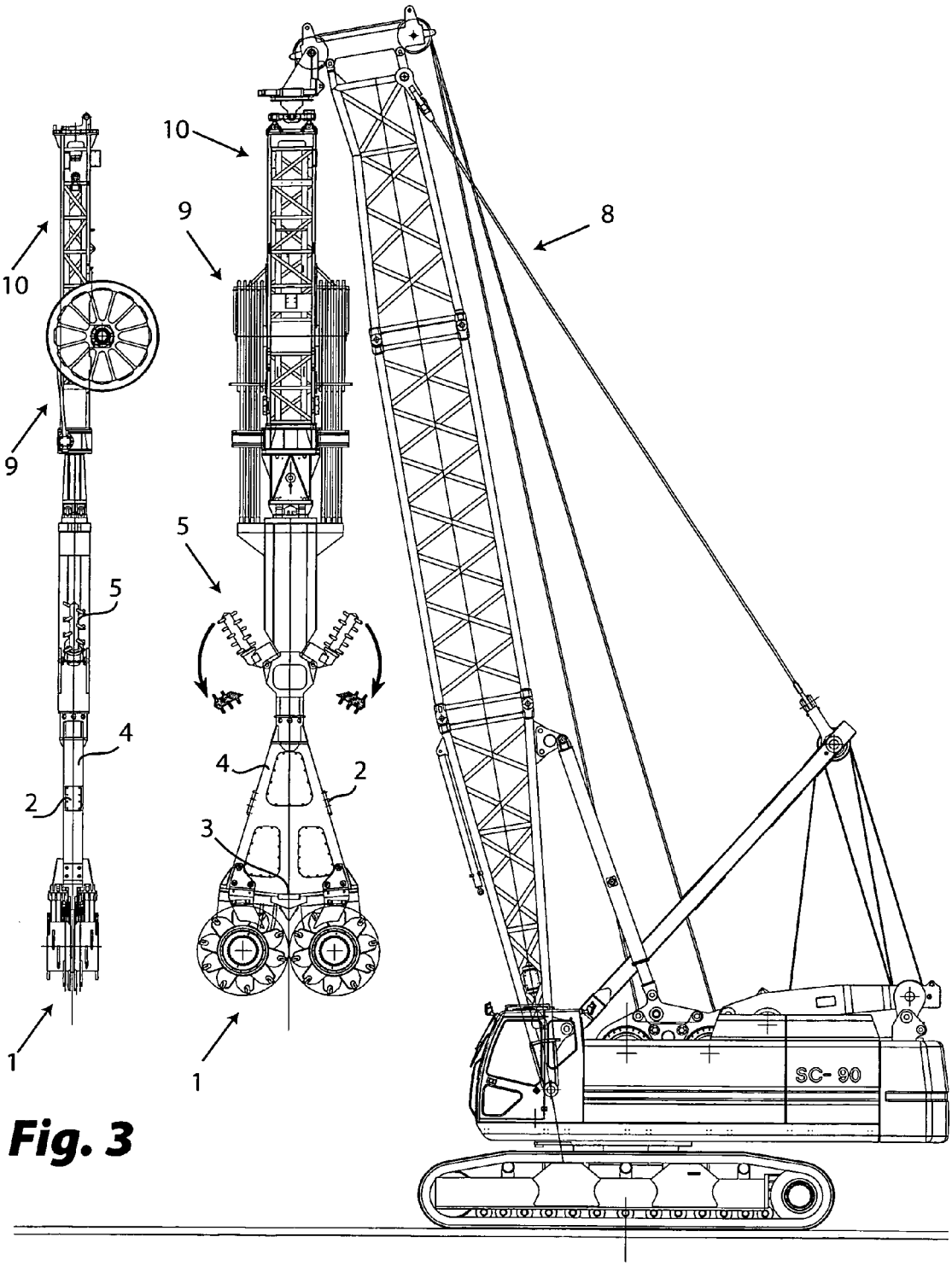
FIGS. 3 and 4 illustrate respectively in frontal and lateral view the excavation device according to the present invention still in a first form of embodiment and mounted on a second kind of machine with a swinging boom.

In an alternative form of embodiment, which is shown in FIGS. 3 and 4, the rod 6 is replaced with a cable system 8 in order to increase the depth which may be reached. Furthermore an external guide system 9 is used suspended from the machine (crane) with a hollow prismatic section and an inner guided element 10 with an equally prismatic section.

The two guide elements are engaged with the device on the outside and during the first few meters of drilling. The device is rendered independent at greater depths and is guided along the walls of the excavation.

Figure 6:
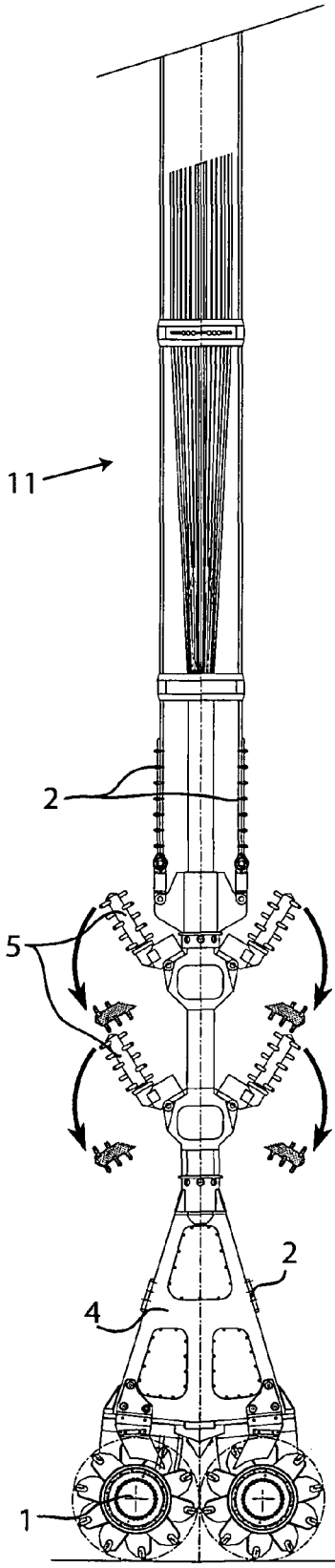
FIGS. 5 and 6 illustrate respectively in frontal and lateral view the excavation device according to the present invention in a second form of embodiment and mounted on a member with cables.
Figure 5:
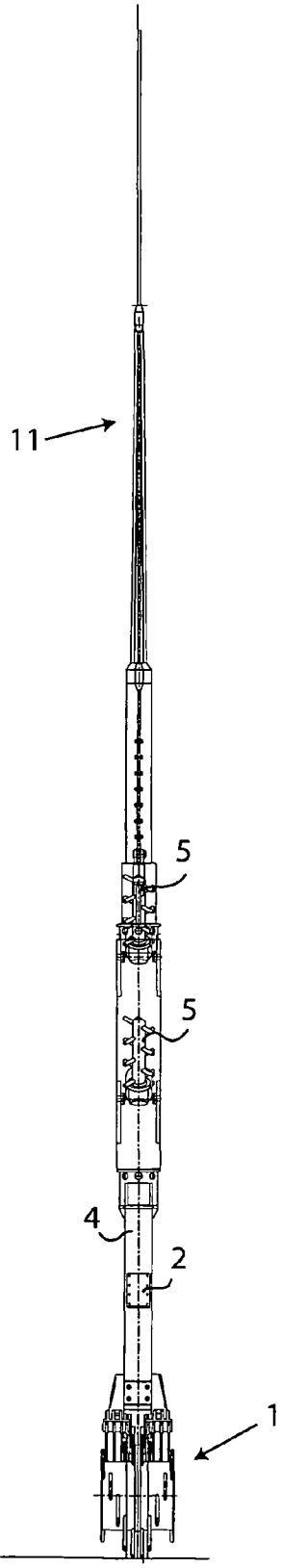

FIGS. 5 and 6 show a further form of embodiment in which the excavation device is supported by a cable system 11, but above all there are two overlapping pairs of milling members 5 instead of a single pair. In this case the force of friction and the torque of the milling group are considerably increased which means that the results obtained are optimised.

Figure 7:
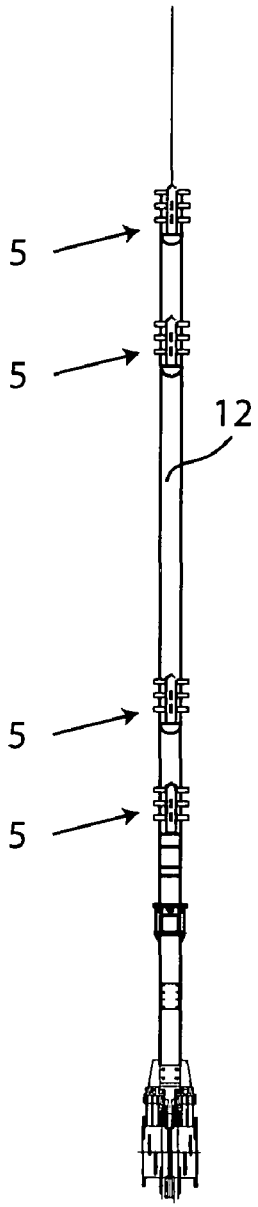
FIGS. 7, 8 and 9 illustrate respectively in frontal view (FIG. 7) and lateral view in two different operating positions (FIGS. 8 and 9) the excavation device according to the present invention in a third form of embodiment and still mounted on a member with cables.
Figure 8:
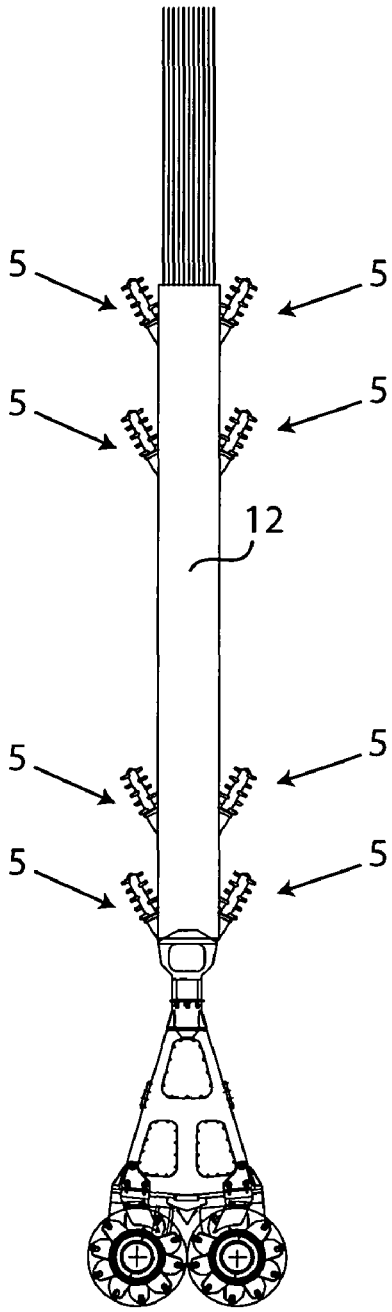
Figure 9:
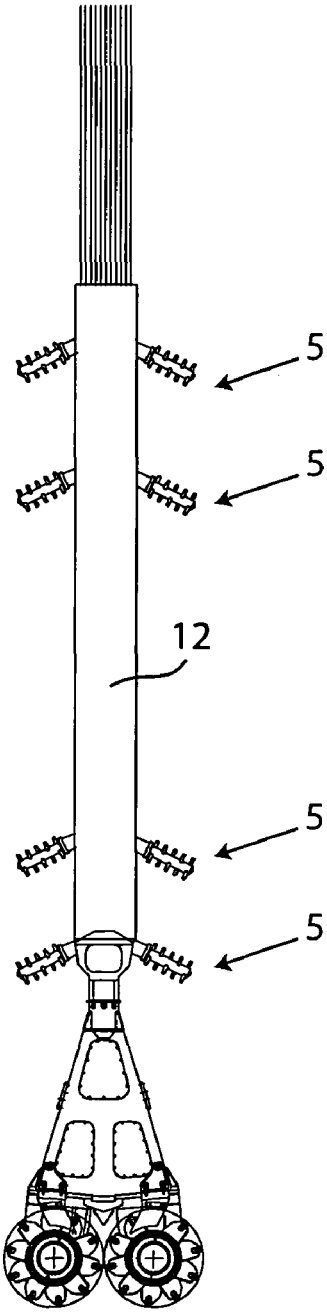

Again with the intention of improving the function of the milling group it may also be made up of several pairs arranged at a distance from each other along a structure 12 which supports them as illustrated in FIGS. 7, 8 and 9.

The structure 12 is of a flattened and elongated shape in such a way as to maintain a distance between the various corrective forces and to be substantially far from the walls of the excavation.

Again with the aim of correcting the direction of excavation in the direction away from the plane of the panel and in the torsional direction of the panel, the correcting means, rather than the milling members 5 arranged in one, two or more pairs as described above, may be mixing members for the mixed earth, preferably arranged in its upper part and having substantially vertical rotation axes.

Figure 11:
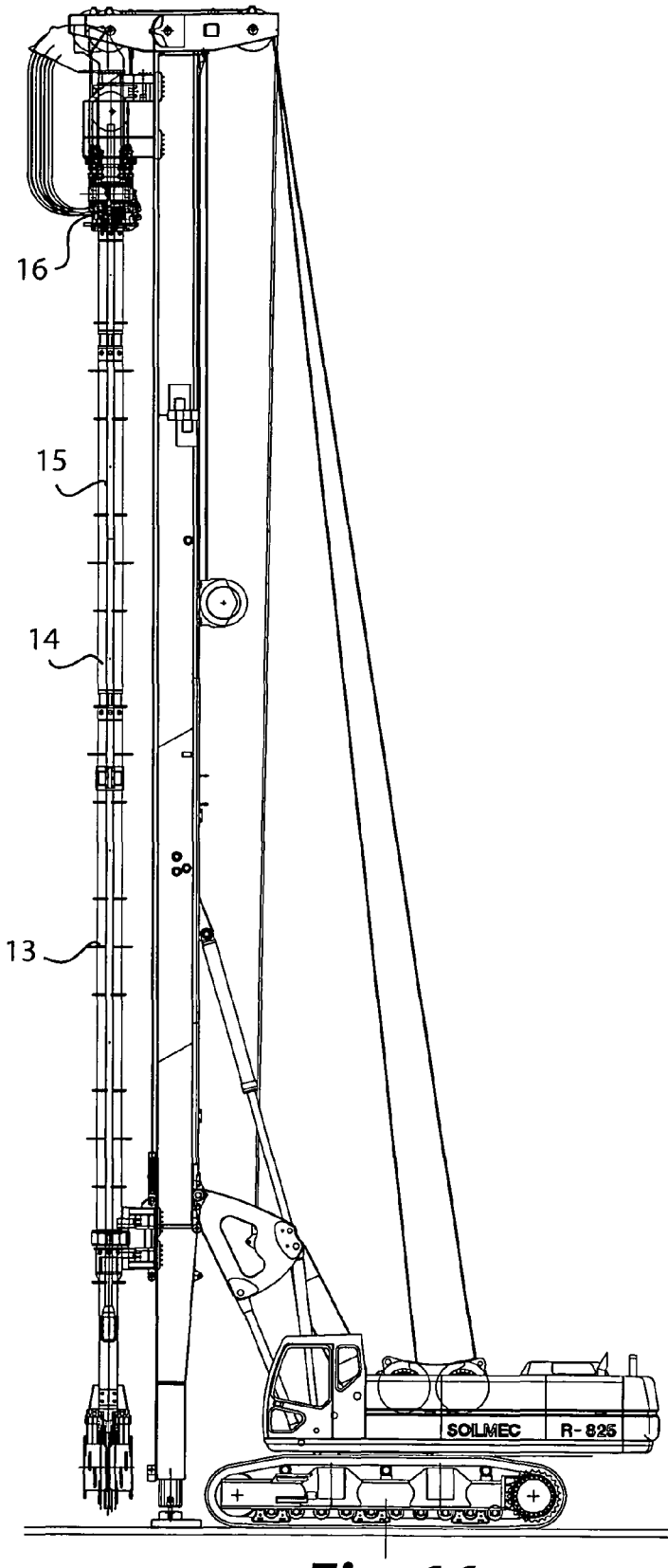
FIGS. 10 and 11 illustrate respectively in frontal and lateral view the excavation device according to the present invention in a further form of embodiment and mounted on a machine with a rigid rod.
Figure 10:
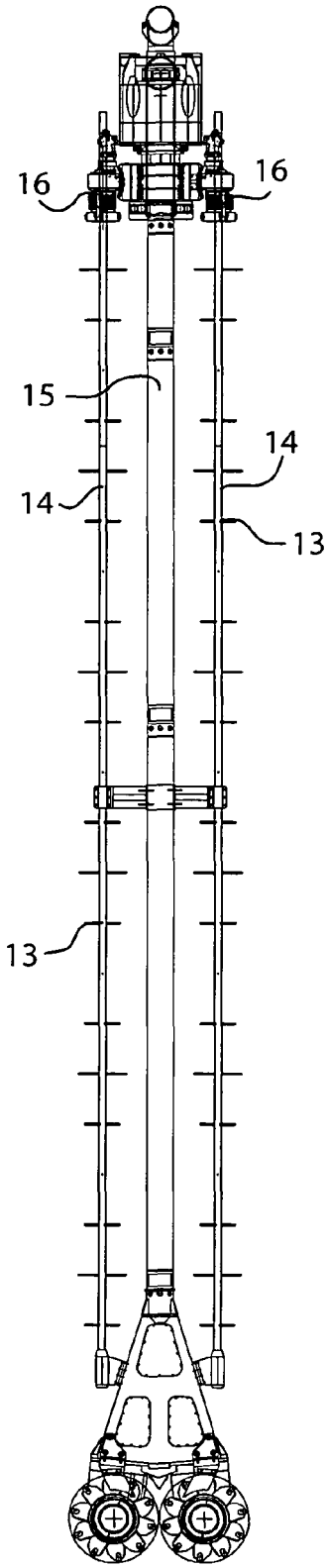

These mixing members are also shown in FIGS. 10 and 11 and are made up of appendices 13 which extend laterally from vertical rods 14. The rods 14 are positioned laterally and parallel to the antenna 15 and rotate around their own longitudinal axis controlled by motors 16 which are positioned above.

The appendices 13 are of a variable number and length according to necessity and their ends act on the surrounding earth during the rotation of the rods 14 which support them when they are rotated by the motors 16.

The reaction of the torsional torque, which is applied to the lateral ends or mixing members 13 in order to maintain the earth in motion, also acts on the excavation device. Thus, if the mixing members 13 rotate in the same direction, the excavation device tends to rotate twisting in the opposite direction.

If instead the mixing members are made to rotate in the opposite direction, the torque is eliminated, but not the friction force on the surrounding material. For reasons of symmetry the residual force travels in a direction which is perpendicular to the plane of the diaphragm, precisely in the main direction. Inverting the direction of rotation of the mixing members 13 also inverts the direction of the correcting force.

In order to produce a feed without correcting force the mixing members are not made to rotate or are intermittently activated in one direction and then in the opposite direction.

Alternatively two pairs of such members may be installed and kept in continuous opposite pair rotation.

The upper mixing members fulfil two further advantageous aims.

One of these is to keep the fluidised earth in motion in the area above the excavation device. This motion slows down the phenomenon of the hardening of the aggregating fluid thus consenting the introduction of such a fluid during the drilling phase, extending the mixing time to the total return time and thus improving the quality of the mixing operation. On the other hand, the extraction time decreases because it is not conditioned by the control of the dosage of the aggregating fluid.

As the aggregating fluid is introduced in the excavation phase, it also functions as a fluidising liquid, thus avoiding the need for the introduction of water during the first phase. This alternative has the effect of drastically reducing the total amount of fluid which has to be introduced into the excavation, and consequently decreases the amount of waste fluid which generally overflows throughout the whole process and which results in problems relating to the disposal of special waste and an increase in costs.

The other advantage is that in the case of emergencies (cave-ins, temporary breakdowns which result in the hardening of the mixture) the mixing members may be used to re-open a return route through the mixed material, thus permitting the retrieval of the equipment.

The upper mixing members may be produced in orientating fashion. This would extend their field of action in terms of mixing, as well as in terms of extraction from the excavation in the case of an emergency. The control of the direction may also improve the correcting effect which has been described above.

The invention claimed is:

1. An excavation device for in situ mixing of earth for the formation of underground walls or diaphragms comprising:

disaggregating means at a lower part of the device for the disaggregation of the earth;

a plurality of motorized milling members positioned above the disaggregating means for milling and correcting torque along the direction of the excavation, each of the motorized milling members having a separate associated longitudinal axis and being driven to rotate and create a torque around the associated longitudinal axis keeping the earth in motion; wherein the longitudinal axes of the milling members lie in a plane parallel to the direction of the excavation.

2. Device according to claim 1 wherein each of the milling members are driven to rotate to apply torque to the device in a direction opposite to torque created by the disaggregating means.

3. Device according to claim 2 wherein the milling members comprise appendices which extend laterally from vertical rods, which are positioned laterally and parallel to an antenna of the machine; the rods rotate around the associated longitudinal axis controlled by motors which are positioned above the disaggregating means.

4. An excavation device for in situ mixing of earth for the formation of underground walls or diaphragms comprising:

disaggregating means at a lower part of the device for the disaggregation of the earth;

correction means positioned above the disaggregating means for the direction of the excavation, each of the correction means rotating around an associated longitudinal axis;

a body;

wherein the correction means for the direction of the excavation are milling members connected by a hinge to the body and pivot about the hinge.

5. Device according to claim 4 comprising two of the milling members which are arranged diametrically opposite each other on the body of the excavation device.

6. Device according to claim 4 comprising two pairs of the milling members, the members of each pair being arranged diametrically opposite each other on the body of the excavation device.

7. Device according to claim 4 comprising a plurality of pairs of the milling members, spaced along the upper structure of the body of the excavation device, the members of each pair being arranged diametrically opposite each other on the body of the excavation device.

8. Device according to claim 4, wherein each member of each pair of milling members can rotate in the same or in the opposite direction in relation to the other member of the same pair.

9. Device according to claim 7 wherein the support structure of the milling members comprises a flattened and elongated shape.

10. A method carried out by an excavation device having direction correction means comprising a pair of driven rotating members for correcting direction of excavation, each of the rotating members defining a longitudinal axis, the excavation device having disaggregating means at a lower part of the excavation device below the correction means, the method comprising:

producing a first correcting torque about the longitudinal axis of each of the rotating members by the correction means for correcting a direction of rotation with all the rotating members driven to rotate in the same direction;

producing a second correcting torque by the correction means for correcting a normal direction on the plane of the excavation with the rotating members driven about the longitudinal axes to rotate in opposite directions.

11. Method according to claim 10, further comprising introducing aggregating fluid during the excavation, said fluid temporarily acting as a fluidising agent.

12. An excavation device for in situ mixing of earth for the formation of underground walls or diaphragms comprising:

disaggregating means at a lower part of the device for disaggregation of the earth;

a plurality of milling members positioned above the disaggregating means, for milling and correcting the direction of the excavation, each of the milling members having a separate associated longitudinal axis and being driven by a motor to rotate about the associated longitudinal axis, the milling members applying a torque to keep the earth in motion.

* * * * *